US005623330A

United States Patent [19]

Ishibashi

[11] Patent Number: 5,623,330

[45] Date of Patent: Apr. 22, 1997

[54] IMAGE FORMING APPARATUS

[75] Inventor: Hitoshi Ishibashi, Tokyo, Japan

[73] Assignee: Ricoh Company, Ltd., Tokyo, Japan

[21] Appl. No.: 632,142

[22] Filed: Apr. 15, 1996

[30] Foreign Application Priority Data

Apr. 14, 1995 [JP] Japan ..... 7-089090

[51] Int. Cl.[6] ..... G03G 15/16

[52] U.S. Cl. ..... 399/310; 428/212; 430/126; 399/44; 399/59; 399/66

[58] Field of Search ..... 355/271, 273, 355/274, 275, 277; 430/124, 126; 428/212

[56] References Cited

U.S. PATENT DOCUMENTS

| | | | |
|---|---|---|---|
| 4,407,580 | 10/1983 | Hashimoto et al. | 355/275 |
| 5,172,173 | 12/1992 | Goto et al. | 355/275 |
| 5,231,452 | 7/1993 | Murayama et al. | 355/271 X |
| 5,390,012 | 2/1995 | Miyashiro et al. | 355/273 |
| 5,461,461 | 10/1995 | Harasawa et al. | 355/274 X |
| 5,557,384 | 9/1996 | Takano et al. | 355/274 |

FOREIGN PATENT DOCUMENTS

| | | |
|---|---|---|
| 62-203169 | 9/1987 | Japan . |
| 3-83771 | 4/1988 | Japan . |
| 3-107957 | 5/1991 | Japan . |
| 4-63385 | 2/1992 | Japan . |
| 7-098549 | 4/1995 | Japan . |
| 7-295337 | 11/1995 | Japan . |

*Primary Examiner*—Matthew S. Smith
*Attorney, Agent, or Firm*—Oblon, Spivak, McClelland, Maier & Neustadt, P.C.

[57] ABSTRACT

In an image forming apparatus, a toner image is formed on an image carrier and the toner image thus formed is transferred onto a transfer material. The image forming apparatus solves troublesome matters of image quality and a transfer material conveying quality due to temperature and/or humidity variations without employing a separate temperature/humidity sensor. The transfer conveying belt includes at least two layers which are, a first layer having a surface resistance rate of $1-10^{10}$~$1-10^{16}$ and a second layer having a surface resistance rate of $1-10^{7}$~$1-10^{11}$, and the second layer is constructed with a rubber material having a temperature/humidity variation of electric resistance which is larger than a temperature/humidity variation of electric resistance of the first layer. Such a transfer conveying belt itself is then used as a temperature/humidity sensor.

20 Claims, 10 Drawing Sheets

IMAGE FORMING APPARATUS

BACKGROUND OF THE INVENTION

1. Field of the Invention

The present invention relates to an image forming apparatus such as a copying machine, a printer, a facsimile device, etc.

2. Description of the Background Art

There exist various types of image forming apparatuses which utilize the Carlson process, such as a copying machine, a printer, a facsimile device, etc. In such image forming apparatuses, an image carrier is formed of, for instance, a photosensitive drum, which is rotated by a motor and is charged uniformly by a charging unit. Thereafter, image exposure is performed on the image carrier by use of an exposing unit and thereby an electrostatic latent image is formed. The latent image is developed by a developing unit with two-components developer or one-component developer in order to obtain a toner image, and the toner image is transferred to a transfer paper fed by a paper feeding apparatus by use of a transferring unit. The transferred image is then fixed by a fixing apparatus. And further, in a two-sided copying mode, after forming an image on a front surface of the transfer paper (after transferring and fixing the toner image as mentioned above), the same processes of forming an image on the rear surface of the transfer paper are executed.

As to transfer mediums, there typically exist two types of transfer mediums, which are, a contact-type transfer medium employing a transfer conveying belt, a transfer roller, etc., and a non-contact transfer medium employing a charger, etc. The transfer conveying belt rotates with a same linear velocity as that of the image carrier. A transfer bias is applied to the transfer conveying belt from a high voltage power source for transferring, and the belt thus biased electrostatically sucks and conveys the transfer paper transported from the paper feeding apparatus, and further the toner image formed on the image carrier is transferred to the transfer paper.

In a case that the development medium employs two-components developer including toner and carrier, the mixing ratio (toner density) of the toner and the carrier of the two-components developer is detected by a toner density sensor. In a toner density controlling portion, the necessity of supplementing the toner for the two-components developer is judged from comparing the detection value of the toner density sensor with a toner density controlling standard value, and in accordance with the result thereof the supplementing of toner is controlled.

In such a construction, the supplementing of the toner from a toner supplementing portion to the two-components developer in the developing means is controlled. In such an image forming apparatus employing the Carlson process, when the image is formed, the electrostatic force is utilized on the respective processes, and thereby the image quality and the transfer paper transporting quality are apt to be affected by variations environmental conditions, such as temperature and humidity.

For instance, in the developing method employing the two-components developer including toner and carrier as the developing medium, although both of the toner and carrier are charged by electrostatic force caused by mutual friction, the electrostatic force varies due to the environmental conditions, such as temperature and humidity. As is apparent from experience, the electrostatic force is apt to occur in the low-temperature environment, while the same is not apt to occur in the high-temperature environment. In order to keep the image density (the density of the toner image) constant on the image carrier, since the electrostatic force caused by the friction between toner and carrier varies due to the environmental conditions, e.g., temperature-humidity, it is necessary to change the toner density of the two-components developer in the developing medium in accordance with changes in the environmental conditions, e.g., temperature-humidity.

Regarding solutions for solving the subject matter as mentioned heretofore, there have been proposed a method of reading out image density on the image carrier and changing the toner density controlling standard value on the basis of the read-out value, and another method of changing the toner density controlling standard value in accordance with the temperature and humidity as measured by a temperature/humidity sensor in the image forming apparatus carrying the temperature/humidity sensor.

And further, a water-containing rate of the transfer paper varies in accordance with the humidity. In a high-temperature/high-humidity environment, when the transfer paper absorbs aqueous vapor, the paper feeding efficiency and the transferring property are considerably lowered, and thereby a non-transportation (a phenomenon of not feeding the transfer paper from the paper feeding portion) occurs or a state of a poor transferring occurs on the image surface. As one proposed solution, such a defect has been solved by utilizing an aqueous vapor removing heater for drying out the paper.

Furthermore, there exists an image forming apparatus in which a temperature/humidity sensor is installed and various controls are performed by the output signal of the temperature/humidity sensor, or another image forming apparatus requiring control by the output signal of the temperature-humidity sensor. In a low-cost image forming apparatus, however, a system for effectuating various controls based on the outputs signal of the temperature/humidity sensor is omitted for the sake of cost reduction.

Japanese Laid-open Patent Publication No. 2-12385/1990 describes an image forming apparatus for roughly calculating a resistance value of a transfer roller and controlling a transferring condition (charging) based on the detected resistance value. Japanese Laid-open Patent Publication No. 4-63385/1992 describes an image forming apparatus having a humidity sensor provided therein and controlling a transferring condition on the basis of an output signal of the humidity sensor.

And further, in recent years, based on the technology trend of conserving the global environment, many devices have implemented a contact transfer medium employing a transfer conveying belt, a transfer roller, etc., which generate very little ozone, instead of the conventional non-contact type transfer medium employing a charger. Regarding the transfer conveying belt, Japanese Laid-open Patent Publication No. 62-203169/1987 and Japanese laid-open Patent Publication No. 63-83771/1988 describe such a belt. All of these above-mentioned apparatuses are formed with a construction dispersing carbon black, metal powder, pure cotton cloth, etc., in the conveying belt as an electrically conductive substance, in order to obtain an intermediate substantial resistance value by use of an elastic rubber material for the transfer conveying belt.

Furthermore, in the transfer conveying belt employing the elastic rubber material, there is a method of utilizing a conductivity of a polymer, as another method of giving the rubber semiconductivity.

SUMMARY OF THE INVENTION

Accordingly, one object of the present invention is to provide a novel image forming apparatus which overcomes the drawbacks in the background art devices.

A more specific object of the present invention is to provide a novel low-cost image forming apparatus which does not utilize a temperature-humidity sensor for the reason of cost reduction, simplification, etc. In this novel approach, there may occur a difference between respective image densities in comparison with the image outputted in an environment of low temperature and low humidity (the image formed on the transfer paper) and an image outputted in another environment of high temperature and high humidity, which difference is taken into consideration.

And further, in an image forming apparatus utilizing a humidity removing heater, the water-containing rate of the transfer paper may be excessively lowered by the heater in an environment of low temperature and low humidity. In this instance, a dielectric constant of the transfer paper becomes large, and an electric charge is not apt to escape from the transfer paper, and thereby double paper feeding (mis-paper-feeding) occurs. Such mis-feeding signifies that when the transfer paper is fed from the paper feeding portion, the paper is not fed surely sheet by sheet, and two or more sheets of paper may be improperly fed at the same time. And further, since the transfer paper is charged excessively at the time of forming the image on the surface of the transfer paper, for instance in a "two-sided" copying mode, when the image is formed on the rear surface of the transfer paper, there occurs a troublesome matter that the toner image on the transfer paper is disturbed, and thereby an abnormal image appears in the process of transporting the transfer paper from a transferring step to a fixing step.

Namely, the humidity removing heater provided in an apparatus for the purpose of solving the troublesome matter caused by humidity-absorbing by the transfer paper in a high-humidity environment causes a troublesome matter in a low-humidity environment contrary to the expectations. For this reason, in the case of employing a humidity removing heater, it may be necessary to perform ON/OFF control of the humidity heater essentially in accordance with the temperature-humidity environment. However, in a low-cost image forming apparatus which does not employ a temperature-humidity sensor for the sake of cost reduction cost saving, it is the present state that ON/OFF control of the humidity removing heater is not performed in accordance with the temperature-humidity environment. And further, in such a low-cost apparatus, it is also the present state that both of ON/OFF control of the humidity removing heater and various controls based on an output signal of a temperature-humidity sensor are omitted.

The present invention is also directed to overcoming such drawbacks.

Furthermore, in an image forming apparatus employing a transfer conveying belt with a construction made of a mixture of a rubber material and a conductive substance kneaded with each other, although the apparatus has a merit that a resistance value of the transfer conveying belt is comparatively stable against variations in the temperature-humidity environment, it is difficult to uniformly disperse the conductive material, such as carbon, into the rubber material, and thereby an unevenness of the resistance value in the circumferential direction becomes large. Consequently, in such a device a partial transfer defect on the output image and an abnormal image on the printed image surface, etc., occurs on some occasions.

Furthermore, in an image forming apparatus employing a transfer conveying belt having a construction of dispersing carbon into a rubber material, there occurs a troublesome matter such as a time-elapsing variation of the transfer conveying belt. In a case that the transfer conveying belt is left alone for a long time, the resistance value of the transfer conveying belt tends to increase as time elapses. On the contrary, in a case that the transfer conveying belt is suspended in a unit, the resistance value of the belt tends to decrease over time. However, on both occasions, the resistance value becomes stabilized after a predetermined time period.

The resistance value of the returning rate of the transfer conveying belt (the ratio between the resistance value of the transfer conveying belt measured before leaving the belt alone for a long time and the resistance value thereof measured in a state of suspending on the unit) tends to become worse for longer leaving periods as a general tendency. And further, since the unevenness per each transfer conveying belt is large, it is almost impossible to anticipate the resistance value of the transfer conveying belt at the time of using the belt in practice.

After leaving the transfer conveying belt alone for a long time, the belt is installed on a unit and the image is outputted therefrom, and there may occur some troublesome matters that the resistance value of the transfer conveying belt becomes excessively large, and thereby a transferring defect occurs. Furthermore, as a manufacturing defect, even though some carbons of a same grade and same structure are composed by a same amount, the structure thereof is destroyed due to the kneaded mixture, and thereby an unevenness of the resistance value almost doubles at the time of manufacturing the transfer conveying belt. This is also a troublesome matter to be solved.

For the above-mentioned reasons, although a resistance value of a transfer conveying belt made of a rubber material kneadedly mixed with a conductive substance has a merit of not being hardly affected by temperature-humidity variations, such a transfer conveying belt has not yet been put in practical use. Furthermore, the troublesome matters result not only in a transfer conveying belt kneadedly mixed with carbon, but also in a belt kneadedly mixed with other conductive substances.

A transfer conveying belt utilizing conductivity of a polymer has several merits; such as, that the resistance value thereof has no unevenness in the circumferential direction, that the resistance value does not change as time elapses, and that there occurs no unevenness of the resistance value at the time of manufacturing the belt. On the contrary, such a transfer conveying belt has a demerit; that the electric resistance value of the polymer (ion conductivity) is largely affected by temperature/humidity variations. If the range of the resistance value variation of the transfer conveying belt due to temperature/humidity variations is within certain values (e.g. the variation range of the resistance value variation is not larger than an order of 3, at low temperature/low humidity: 10° C., 15% RH (relative humidity); and at high temperature/high humidity: 30° C., 90% RH), a preferable transferring property and a preferable transfer paper transferring property can be secured over the entire environmental range (10° C., 15% RH to 30° C., 90% RH).

As a more concrete example of these terms, assume that the surface resistance rate value at 10° C. 15% RH is $1\times10^{10}$ [Ω] (Log R=10), and that the surface resistance rate value at 30° C., 90% RH is $1\times10^{8}$ [Ω] (Log R=8). Then, the variation of the surface resistance rate value=(the surface resistance rate value at 10° C., 15% RH)−(the surface resistance rate value at 30° C., 90% RH)=(Log $R_{10°\ C.\ 15\%\ RH}$−Log $R_{30°\ C.\ 90\%\ RH}$)=10−8=2. Namely, the value "2" is within the range of not less than an order of 0.5 and not more than an order of 3.0.

On the other hand, in a case that the variation range of the resistance value of the transfer conveying belt due to the temperature/humidity variations is considerably large (in a case that the variation range of the resistance value variation is not smaller than an order of 3, at low temperature/low humidity: 10° C., 15% RH; and at high temperature/high humidity: 30° C., 90%), when the resistance value of the transfer conveying belt at the normal temperature is at a low value within the range, a transferring defect occurs at the low temperature/low humidity. On the contrary, when the resistance value of the belt at the normal temperature is at a high value within the range, although the occurrence of a bad transferring at the low temperature and the low humidity can be eliminated, a transferring defect and a transfer paper conveying defect occur. Consequently, image quality is largely affected by the environmental conditions. Namely, the above matter is a defect; that in such a device the resistance value of the transfer conveying belt is greatly dependent on temperature/humidity conditions.

The present invention has been made in consideration of the above-mentioned actual circumstances and troublesome matters to be solved.

It is an object of the present invention to solve the points at issue as mentioned heretofore.

It is another object of the present invention to provide an image forming apparatus capable of eliminating such troublesome matters regarding image quality and the transfer material conveying quality in connection with the changes in temperature and/or humidity without employing a separate temperature/humidity sensor.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 5(*b*) is a flow chart showing an operation of the circuit of FIG. 4;

DETAILED DESCRIPTION OF THE PREFERRED EMBODIMENTS

Figure 1:
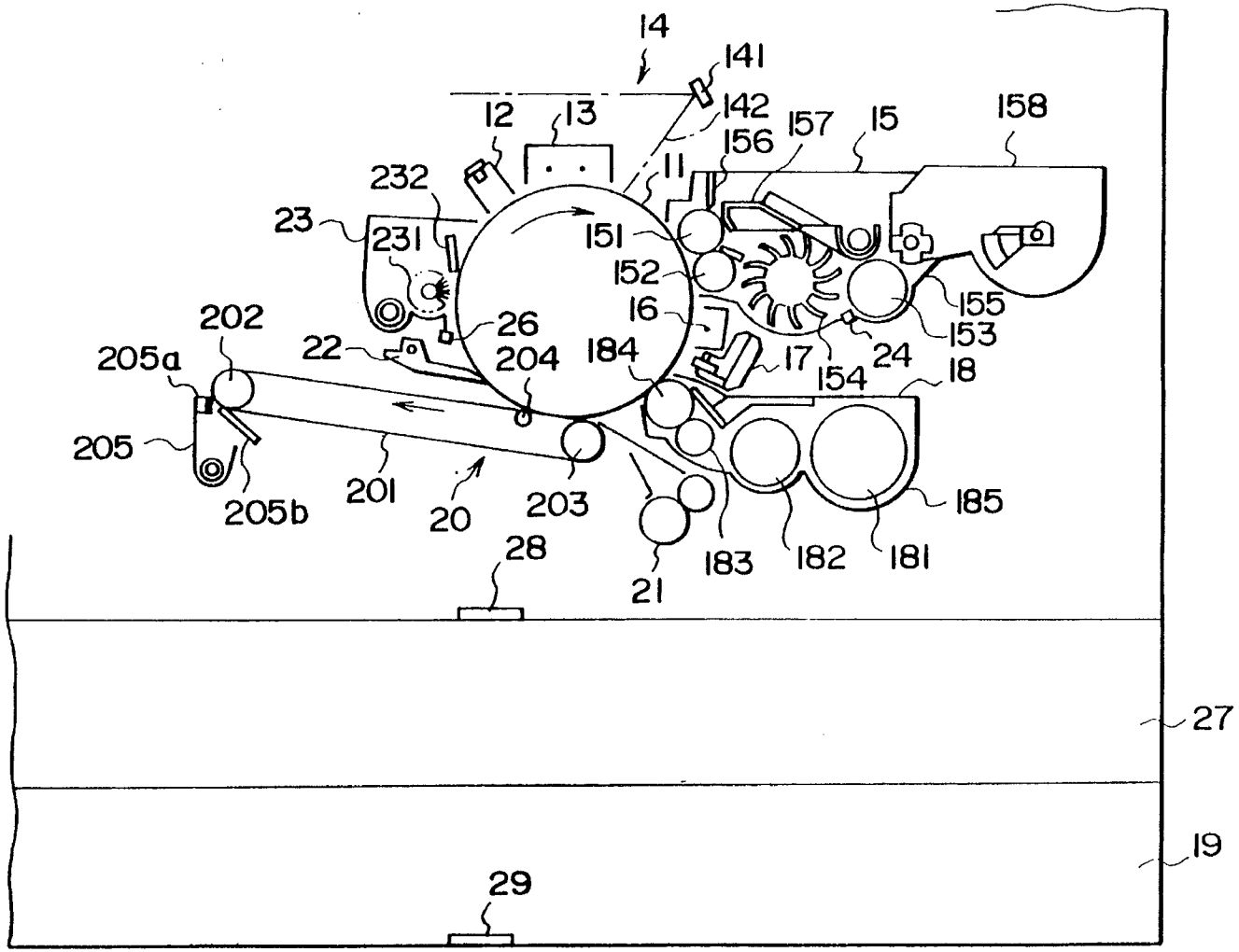
FIG. 1 is a cross sectional view showing an outline of a first embodiment of the present invention.

Referring now to the drawings, wherein like reference numerals designate identical or corresponding parts throughout the several views, and more particularly to FIG. 1, first embodiment of the present invention is shown.

The first embodiment is an embodiment relating to an example of a two-color image forming apparatus for forming both of the images of two colors at a same time and which includes a charging medium constructed with a charger, a light-exposing medium constructed with a writing-in unit, and two sets of developing apparatuses. In order to attain the aforementioned objects, the first embodiment employs semiconductor rubber having an electric resistance which varies based on temperature-humidity on a basic substrate of a transfer conveying belt as a contact type transfer medium, and thereby the transfer conveying belt can be used as a temperature/humidity sensor in addition to its essential functions of conveying sheet paper. The transfer conveying belt can then be utilized to calculate approximate values of temperature/humidity from the value of a voltage applied to the transfer conveying belt from a high-voltage power source, and various controls can be performed on the basis of the calculated values.

At the time of forming an image, an image carrier constructed with a photosensitive drum 11 is rotatively driven by a main motor. At first, light rays are radiated onto the surface of the photosensitive drum 11 from an electric charge removing medium 12 constructed with a charge removing lamp, and the charge on the surface of the photosensitive drum 1 is removed, and thereby the surface electric potential on the photosensitive drum 11 becomes a standard potential of 0 V~100 V. Next, the photosensitive drum 11 is applied with an electric charge from a first charging medium 13 constructed with a charger in order to uniformly charge the photosensitive drum, and thereby the surface potential of the photosensitive drum 11 becomes, as an example, approximately −850 V.

And further, a digital recorded image information of, e.g., a manuscript conveyed from a conveying apparatus not shown in FIG. 1 (e.g. black image information) is received by a line driver circuit in a light-exposing medium 14 constructed with a first writing-in unit, and the received image information is amplified by a laser driver circuit (not shown). The aforementioned digital recorded image information may be a multiple signal of 8 bits per one pixel, and the laser driver circuit energizes a laser diode (causes the laser diode to emit light rays), corresponding to the digital recorded image information emitted from the line driver circuit 14.

The laser light rays radiated from the laser diode may be deflected by a light deflector constructed with a polygon mirror (not shown), and the deflected light rays may pass through an fθ lens and may then be reflected on a first mirror, a second mirror (not shown), and a third mirror 141 to be radiated onto the photosensitive drum 11 in order, to form the image thereon. Namely, the black image component of the manuscript is light-exposed on the surface of the photosensitive drum 11. To state more concretely, the surface potential on the portion (image portion) of the photosensitive drum 11 radiated with the laser light rays 142 from the third mirror 141 becomes 0–100 V, and thereby an electrostatic latent image is formed on the photosensitive drum 11 corresponding to the black image component of the manuscript.

Next, toner is attached to the image portion on the photosensitive drum 11 by action of development by use of a first developing apparatus 15, and thereby the electrostatic latent image formed on the photosensitive drum 11 is converted to a visible toner image. At the time of the developing operation, developing rollers 151 and 152, an agitating roller 153, and an agitating feather 154 are rotatively driven by a driving medium, and further two-components developer contained in a developer container 155 and including toner and carrier is agitated by the agitating roller 153 and the agitating feather 154 and is conveyed therefrom.

A developing roller 151 absorbs the developer conveyed by the agitating feather 154 by a magnet contained therein and carries the developer by action of the rotation thereof. The developer on the developing roller 151 is partly scraped off by the doctor member 156 and is adjusted to a predetermined constant amount (volume). Thereafter, the adjusted developer passes through the space between the photosensitive drum 11 and the developing rollers 151 and 152 and returns to the interior of the developer container 155. The developer is agitated again by the agitating roller 153 and the agitating feather 154 and is conveyed therefrom. And further, the developer scraped off from the developing roller 151 by use of the doctor member 156 falls down into the developer container 155 through the separator 157, and the developer is also agitated by the agitating roller 153 and the agitating feather 154 and is conveyed therefrom.

In such a manner, the developer circulates and the electrostatic latent image formed on the photosensitive drum 11 is developed by the developer passing through between the photosensitive drum 11 and the developing rollers 151 and 152. And further, toner is supplemented from a toner supplementing portion 158 to the developer in the developer container 155. A developing bias voltage of approximately −550 V is applied to the developing rollers 151 and 152 from an electric power source, and the toner is attached to the image forming portion on the photosensitive drum 11 by the developing apparatus 15. However, the voltage on the non-image portion of the photosensitive drum 11 is kept to approximately −850 V, and thereby the toner is not attached thereto even by the development by use of the developing apparatus 15.

In a charging apparatus there may typically be three modes of operation. A first mode is a single-color (black)-mode, or what is also known as a black-and-white mode, in which only a single color black image is formed on a white background paper. Another mode is a two-colors mode in which two colors are printed on the background white paper. This mode will typically include either printing of black and red images or black and blue images on the background white paper. Typically, the color black is included in these two colors. A third operation mode is a single-color (red/blue) mode in which a single color of red or blue is formed on a background white paper; in this mode the color black is not included.

The first charging process of charging such a photosensitive drum 11 by use of the charger 13, the first exposing process of performing the exposure on the photosensitive drum 11 by use of the first writing-in unit 14, and the first developing process of developing by use of the first developing apparatus 15 are performed only in the case of selecting the two-colors mode, or the single color (black), i.e., the black-and-white mode, by use of an operating portion. When a single-color (red/blue) mode is selected by the operating portion, the first writing-in unit 14 is placed in a not-operating state. Consequently, the black toner image is not formed on the photosensitive drum 11.

Stated another way, the first exposing process by the first writing-in unit 14 is utilized with a two-components developer to form a black image on the photosensitive drum. Thus, in both the two-colors mode and the single-color (black) mode, i.e., those modes in which a black image is required to be formed on the photosensitive drum, the first writing-in unit 14 is operational. In the single-color (red/blue) mode in which no black image is required to be formed on the photosensitive drum 11, the first writing-in unit 14 need not operate.

Here, toner density control of the two-components developer in the first developing apparatus 15 is further explained hereinafter.

Figure 2:
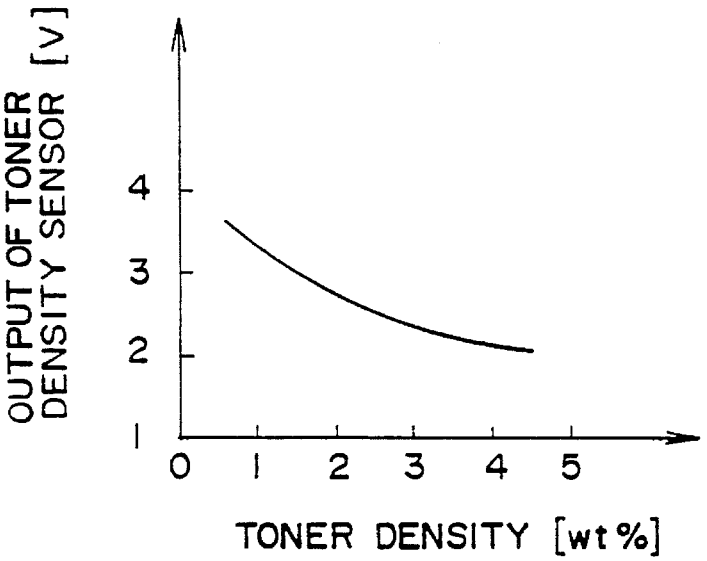
FIG. 2 is a graph showing a relationship between toner density and an output of a toner density sensor in the first embodiment.

A toner density of the two-components developer in the first developing apparatus 15 is detected by a toner density sensor 24. Initially, the toner density of the two-components developer in the first developing apparatus 15 may be set to an initial desired value, e.g., 2.5%. In such a situation, the output value of the toner density sensor 24 is adjusted so as to become, e.g., 2.5 V. The output voltage of the toner density sensor 24 then changes in accordance with the toner density of the two-components developer in the first developing apparatus 15 as shown in FIG. 2.

Figure 3:
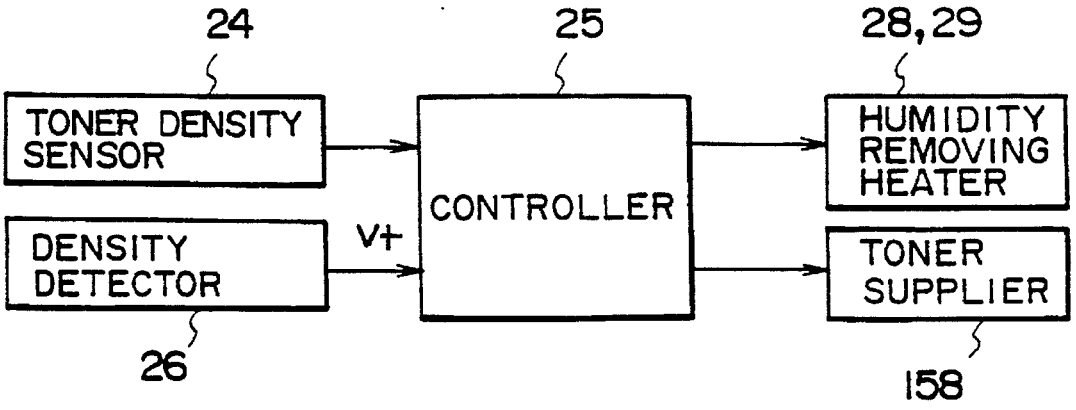
FIG. 3 is a block diagram showing a part of a circuit construction in the first embodiment.

A controller 25, see FIG. 3, employed as a control medium for performing various controls, such as toner density control, judges the necessity of supplementing toner to the two-components developer in the first developing apparatus 15 from comparing the output voltage of the toner density sensor 24 with a toner density control standard value Vref. For instance, the output voltage vt of the toner density sensor 24 is compared with the toner density control standard value Vref, and the necessity of the toner supplementing is judged based on this comparison. Then the toner supplementing portion 158 is controlled in accordance with the judgment result, and thereby the toner supplementation to the two-components developer in the first developing apparatus 15 from the toner supplementing portion 158 can be controlled.

In the image forming apparatus as shown in the embodiment of the present invention, a toner density control is performed in combination with the toner density control as described above with the other toner density control as mentioned hereinafter.

To state briefly, in the toner density control as described above, the operation of comparing the toner density (Vt) in the developing apparatus with the toner density control standard (reference) value (Vref) is per one sheet of the copied paper so that the toner density in the developing apparatus is always put in a state of Vref≧Vt.

In the other toner density control as mentioned below, the toner density control standard reference value (Vref) described above is renewed (amended) per 200 sheets of copied paper. The toner density control is performed in the developing apparatus 15.

In order to renew (amend) the above standard value (Vref) per 200 sheets of copied paper, an image of a P-sensor pattern (25 mm×25 mm) is formed on the photosensitive drum 11 per 200 sheets of copied paper. The P-sensor pattern is formed on the photosensitive drum 11 as a latent image by use of the first writing-in unit 14. And thereafter, the latent image formed on the photosensitive drum 11 is converted to a visible toner image by use of the first developing apparatus 15.

At the time of forming the P-sensor pattern image, the transfer belt unit 20 is detached from the photosensitive drum 11. Therefore, the P-sensor pattern image thus formed passes through the transferring process and reaches the density detector 26.

Here, a reflection-type photo-diode is employed as the density detector 26. The above reflection-type photo-diode (sensor) radiates light rays of a constant intensity to an object to be measured, and the intensity value of the light rays reflected to and received by a light-receiving element is converted to a voltage value Vt. Thereby, the detection of the density on the light-receiving surface is performed.

When the image density is strong (dark) the intensity of the reflected light rays becomes weak (small) and thereby the value of the received-light-rays voltage becomes small. On the contrary, when the image density is weak (faint), the intensity of the reflected light rays becomes strong (large) and thereby the value of the received-light-rays voltage becomes large.

A sampling operation between a received light rays voltage (Vsg) on the non-image-forming portion before passing through the P-pattern image and a received-light-rays voltage (Vsp) on the P-pattern image portion is performed by use of the density detector 26 as mentioned above. The detection of the density on the P-pattern image is performed in accordance with the result of comparing the value of the toner image.

The target value of this control may be Vsp/Vsg=0.4/4.0 (=0.1). The value of the received light rays voltage (Vsg) on the non-image-forming portion is previously adjusted so as to make its output value equal to 4.0 V. Consequently, when the value of Vsg is Vsg≧0.4 V, the image density becomes more faint than the target value. In such situations, the toner density control standard value (Vref) is renewed to a lower value in order to increase (raise) the image density.

On the contrary, when the density of the P-pattern image is too strong (dark), the toner density control standard value (Vref) is renewed to a higher value in order to decrease (lower) the image density.

In such a manner, regarding the toner density control performed per one sheet of copied paper, the control operation is done such that the relationship between the renewed control standard value (Vref) and the output value (Vt) obtained by performing the detection per one sheet of copied paper becomes (Vref>Vt). Consequently, the toner density is always kept constant.

Referring to the relationship between the toner density and the output of the toner density sensor as shown in FIG. 2, it is apparent that the control standard value (Vref) of the toner density sensor has to be set to a relatively low value in order to raise (increase) the toner density.

Next, the photosensitive drum 11 passes through the second charging process by the (charging) charger 16, the second exposing process by the second writing-in unit 17, and the second developing process by the second developing apparatus 18.

These processes of the second charger 16, second writing-in unit 17 and second developing process 18 are the processes for developing the color toner (red or blue). Therefore, the above-mentioned units are put in an operational state only when the two modes of the two colors-mode and the single-color (red/blue) mode both for performing color development are selected by the operational part (operation board). When the single color (black)-mode is selected, these units do not operate.

In the two modes of the two-colors mode and the single-color (red/blue) mode both for performing color development, an electric charge is applied to the photosensitive drum 11 by the (charging) charger 16 in the second charging process, and thereby the surface electric potential thereof becomes again approximately −850 V.

The laser light rays emitted from the second writing-in unit 17 are radiated onto the photosensitive drum 11, and thereby exposure of the manuscript document image component of a red or blue is performed. Here, on the photosensitive drum 11, the surface potential thereof on the portion (image portion) radiated with the light rays from the second writing-in unit 17 becomes 0–100 V, and thereby the electrostatic latent image is formed thereon corresponding to the manuscript image component of red or blue.

In the second developing process when the photosensitive drum 11 passes through the second developing apparatus 18, the color toner of red or blue is attached to the image portion of the electrostatic latent image corresponding to the manuscript document image component of red or blue with the developing operation by the second developing apparatus 18, and thereby the electrostatic latent image is converted to a color toner image of red or blue.

In the second developing apparatus 18, agitating rollers 181 and 182, pumping-up roller 183, and developing roller 184 are rotatively driven by a driving device, and the one-component developer including the color toner, e.g., of either red or blue, contained in the developer container 185 is agitated in order to cause the developer to circulate in the container. The developing roller 184 conveys the color toner onto the photosensitive drum 11 and develops the electrostatic latent image corresponding to the manuscript image component, e.g., of either red or blue, formed on the photosensitive drum 11 and converts the latent image to the color toner image, e.g., of either red or blue, by a non-contact method by use of the color toner on the developing roller 184.

A developing bias voltage of approximately −750 V is applied to the developing roller 184 from a power source. Although the color toner is attached to the image portion of the electrostatic latent image corresponding to the manuscript document image component of, e.g., red or blue on the photosensitive drum 11 with the development by use of the developing apparatus 18, the color toner is not attached to the non-image portion on the photosensitive drum 11 even with the development by use of the same developing apparatus 18.

The toner image formed on the photosensitive drum 11 at the time of passing through the developing apparatus 18 is transferred to the transferring material, such as a transferring paper conveyed from a paper feeding apparatus 19 composed of a paper feeding cassette, by a contact type transferring medium 20 employing a transfer conveying belt 201. On this occasion, the transferring paper is fed to a registration roller 21 from the paper feeding apparatus 19, and the registration roller 21 sends out the transferring paper to the contact type transferring medium 20 with a timing so as to cause a tip end portion of the toner image on the photoconductive drum 11 to coincide with a tip end portion of the transferring paper.

The contact type transferring medium 20 includes a transfer conveying belt 201, a driving roller 202 and a dependently moving roller 203, on which the transfer conveying belt 201 is supported, a bias roller 204 brought into direct contact with a rear surface of the transfer conveying belt 201, and a cleaning apparatus 205.

The driving roller 202 is engaged with a main motor through a gear (not shown), and rotates the transfer conveying belt 201 at a time of the main motor's rotation, and at a same time the transfer conveying belt 201 is brought into direct contact with the photosensitive drum 11 by action of a belt attaching/detaching mechanism (not shown). And further, the transfer conveying belt 201 is detached from the photosensitive drum 11 by the belt attaching/detaching mechanism when the main motor is turned off.

Figure 4:
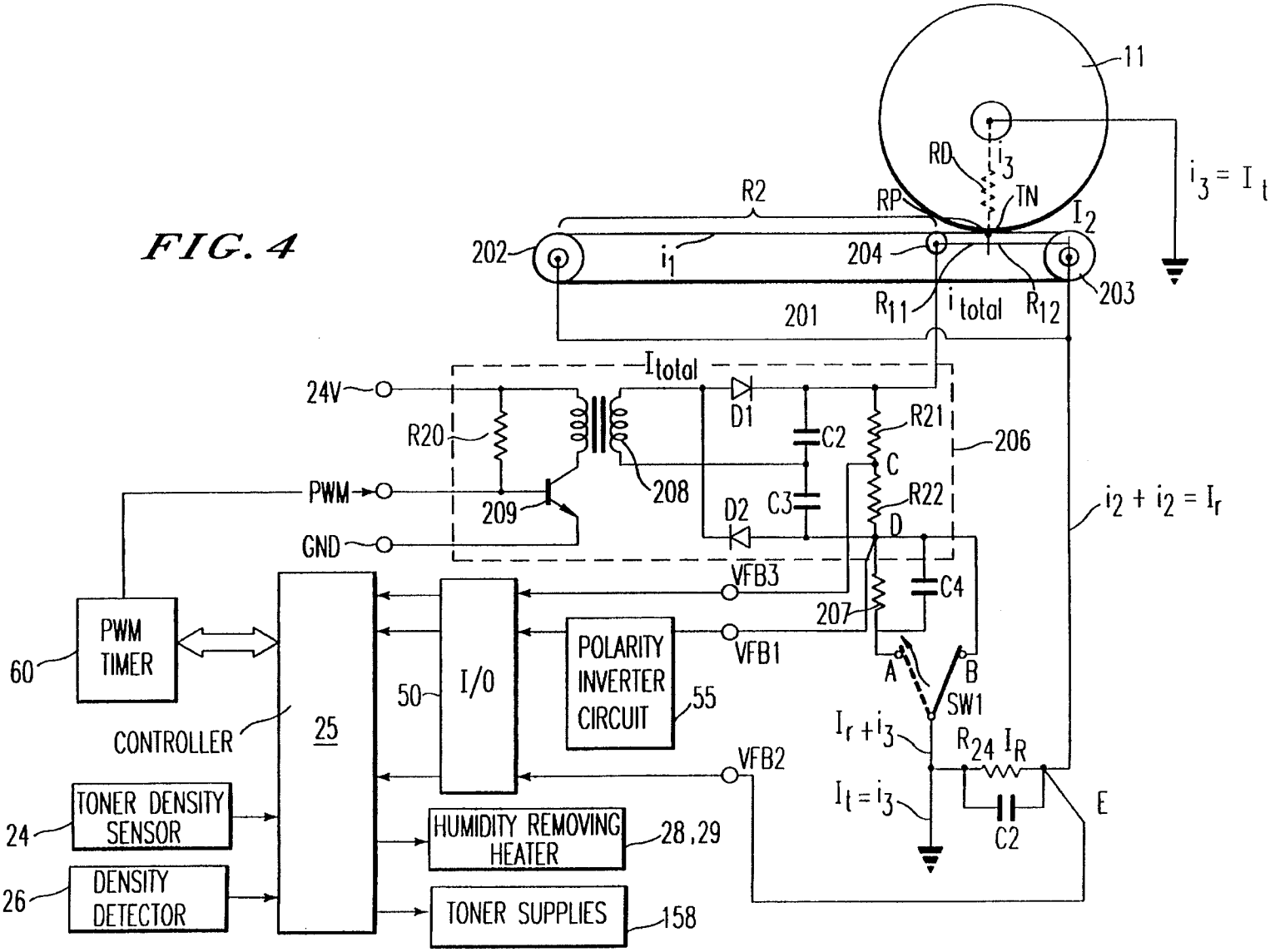
FIG. 4 is a circuit diagram showing a transferring portion in the first embodiment.

When the transfer paper is sent out from the registration roller 21 to the contact type transferring medium 20, a transfer bias of a polarity opposite to the charging polarity of the above-mentioned black toner and color toner is applied to the bias roller 204 from a high-voltage power source 206, see FIG. 4. The electric charge of the polarity opposite to the charging polarity of the toner is applied to the transfer paper at the nip portion (transfer nip portion) between the transfer conveying belt 201 and the photosensitive drum 11 from the high-voltage power source 206 for transferring through the bias roller 204 and the transfer conveying belt 201, and thereby the toner image formed on the photosensitive drum 11 is transferred onto the transfer paper.

The transfer bias is applied to the transfer conveying belt 201 from the high-voltage power source 206 through the bias roller 204, and thereby the transfer conveying belt 201 is electrostatically attached to the transfer paper and conveys the transfer paper accompanying its rotation. After the toner image is transferred to the transfer paper, the transfer conveying belt 201 electrostatically separates the transfer paper from the photosensitive drum 11. The transfer paper not separated from the photosensitive drum 11 is separated therefrom by the separation claw 22 and is conveyed by the transfer conveying belt 201.

The transfer paper is conveyed by the transfer conveying belt 201 and is separated from the belt 201 at the driving roller 202 by action of curvature separation due to the rigidity of the transfer paper itself, and the toner image is fixed on the transfer paper by heating and pressurizing actions of a fixing apparatus (not shown). The transfer paper having the toner image thus fixed thereon is discharged outside of the copying machine as an image-formed document sheet. The remaining toner on the transfer conveying belt 201 is scraped off in the cleaning apparatus 205 by the cleaning brush 205*a* and the cleaning blade 205*b* after separating the transfer paper therefrom. And further, the remaining toner on the photosensitive drum 11 is removed completely in the cleaning apparatus 23 by the cleaning brush 231 and the cleaning blade 232 after separating the transfer paper, and the procedure is then transferred to a next image forming process.

The aforementioned operation is one performed in a one-side copying mode. As to a two-sided copying mode, the operation is performed as follows. As in the case of the one-side copying mode, the transfer paper fed from the paper feeding apparatus 19 is transferred with the toner image on the surface thereof. The toner image formed thereon is fixed by a fixing apparatus. Thereafter, the front and rear surfaces of the transfer paper are reversed (turned over), and the two-side transfer paper is discharged onto a two-side paper feeding tray 27. The two-side transfer paper is then fed from the tray 27, and as in the case of the one-side copying mode, the toner image is transferred onto the rear surface of the transfer paper, and the image thus transferred is fixed by the fixing apparatus. Thereafter, the transfer paper having the toner images thus fixed on both surfaces thereof is discharged outside of the copying machine as a two-sided image-formed document sheet.

Next, the above-mentioned transfer conveying belt apparatus 20 is further explained, referring again to FIG. 4.

The bias roller 204 is brought into direct contact with an inner side of the belt 201 at a down-stream side of the transfer nip position, and the bias roller 204 rotates subsequently to the rotation of the transfer conveying belt 201 driven by the main motor.

Furthermore, both of the driving roller 202 and the driven roller 203 are made of metal and may have a further function as feedback electrodes. The feedback electrode structure of rollers 202 and 203 does not operate as a detector in particular. To state simply, rollers 202 and 203 functioning as feedback electrodes are connected to the lower voltage side of the high-voltage power source 206. The transfer current control is performed such that the value of the current detected by the detecting resistor 20 may become constant.

The driving roller 202 and the dependently driven roller 203 are connected to a low-voltage side (ground side) of a high-voltage power source 206. The low-voltage side terminal of the high-voltage power source 206 is connected to ground through an electric current detecting resistor 207. And further, the photosensitive drum 11 is also connected to ground through a main body of the machine. The current detecting resistor 207 is employed as a current detecting medium for detecting transfer current contributing to the transferring of the toner image.

Figure 5A:
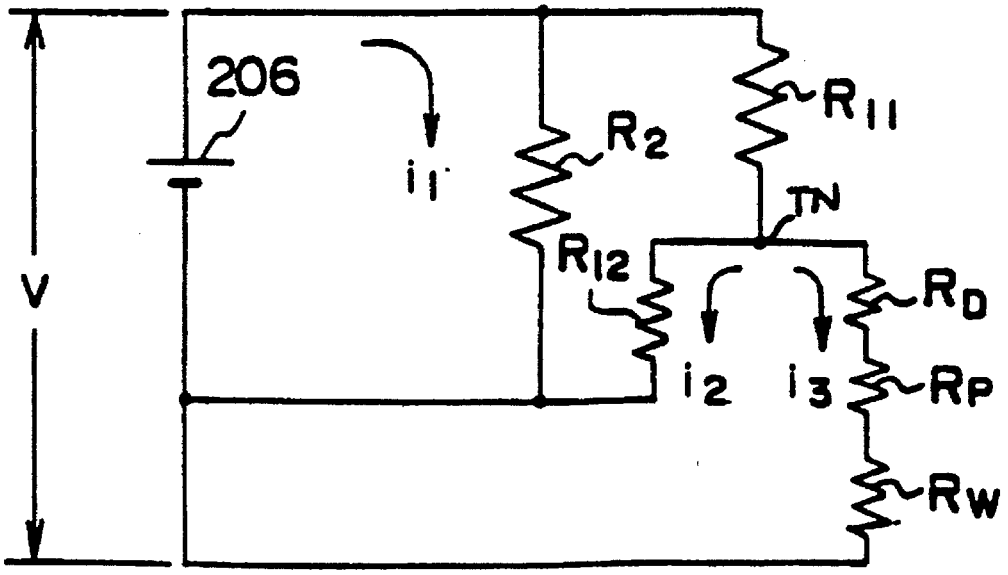
FIG. 5(*a*) is a circuit diagram showing an equivalent circuit of a transferring portion of FIG. 4.
Figure 5B:
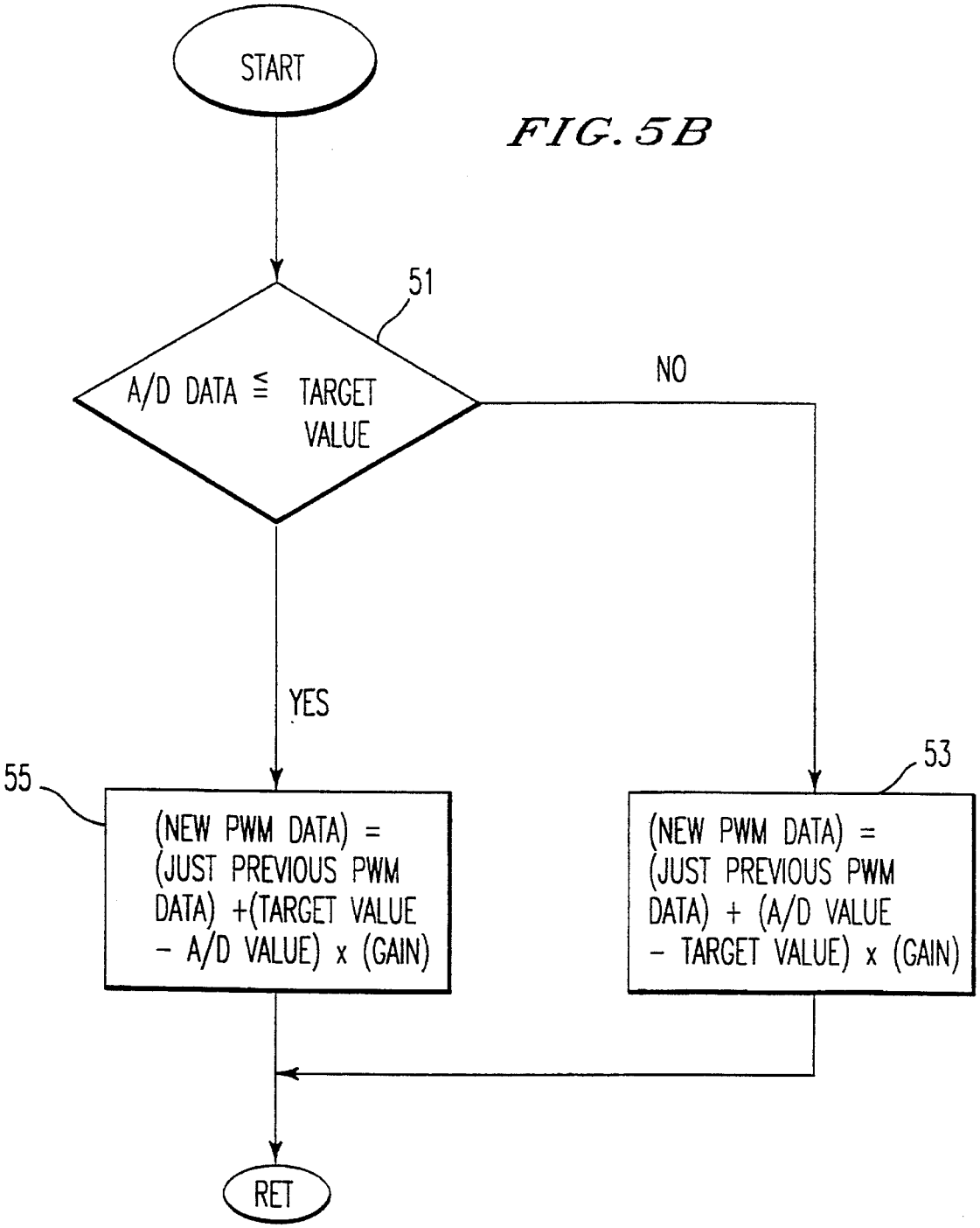

FIG. 5(*a*) shows an equivalent circuit of the transferring portion.

In FIG. 5(*a*), R11 represents a resistance value between the bias roller 204 and the transfer nip TN portion on the transfer conveying belt 201, R12 represents a resistance value between the transfer nip portion and the dependently driven roller 203 on the belt 201, R2 represents a resistance value between the bias roller 204 and the driving roller 202 on the belt 201, RD represents a resistance value of the photosensitive drum 11, and RP represents a resistance value of the transfer paper. A resistance value R1 between the bias roller 204 and the dependently driven roller 203 can be expressed by the following equality:

$$R1=R11+R12.$$

Furthermore, $i_1$ represents the current from the high-voltage power source 206 flowing through the bias roller 204, the transfer conveying belt 201, and the driving roller 202, $i_2$ represents the current from the power source 206 flowing through the bias roller 204, the transfer conveying belt 201, and the dependently driven roller 203, and $i_3$ represents the current from the power source 206 flowing through the bias roller 204, the transfer conveying belt 201, the transfer paper, and the photosensitive drum 11.

The high-voltage power source 206 is turned on with a timing in coincidence with that of conveying the transfer paper sent out from the registration roller 21 and the power source 206 applies a transfer bias to the bias roller 204. The transfer bias current outputted from the high-voltage power source 206 to the bias roller 204 flows through the transfer conveying belt 201, the transfer paper, and the photosensitive drum 11, and a part of the transfer bias current flows through the transfer conveying belt 201, the driving roller 202 and the dependently driven roller 203.

The current $i_3$ flowing from the bias roller 204 to the side of the photosensitive drum 11 through the transfer conveying belt 201 is the transfer current contributing to the transferring of the toner image and the same current $i_3$ flows to ground through the main body of the machine. The current $i_3$ returns to the high-voltage power source 206 through the current detecting resistor 207. And further, the feedback currents $i_1$ and $i_2$ flowing from the bias roller 204 through the transfer conveying belt 201 and respectively through the driving roller 202 and the dependently driven roller 203 return to the high-voltage power source 206. The transfer current flowing through the current detecting resistor 207 can be determined from the electric potential across the both ends of the current detecting resistor 207 and the resistance value of the current detecting resistor 207.

To give a more concrete explanation of the present invention with reference to FIG. 4, it is noted that in FIG. 4 $I_{total}$ represents a current outputted from the high voltage power source 206. The current $I_r$ is the current fed back to the low potential side of the high voltage power source 206 through the driven roller 203 and the driving roller 202 from the high potential side of the high voltage power source 206. The current $I_v$ is the current fed back to the low potential side of the high voltage power source 206 through the resistors R21 and R22 from the high potential side of the high voltage power source 206. The resistor R21 is inserted for the purpose of decreasing the current flowing through resistors R21, R22 and ground from the high voltage power source. As a result, current $I_v$ is very low. The resistor R22 is also utilized for the purpose of detecting applied voltage, and the resistor 207 is utilized for the purpose of detecting total current. The resistor R24 is provided for detecting a feedback current.

The present invention as shown in FIG. 4 also includes a switch SW1 for switching over the case of detecting a total current and a case of detecting an applied voltage.

The operation of the device of the present invention as shown in FIG. 4 can be utilized to detect a total current and an applied voltage, which information can then be utilized so that the belt 201 has a function of a humidity and/or temperature detector, as is also discussed in further detail below.

The method of the present invention for calculating an applied voltage is as follows. The switch SW1 is changed over to a side of applied voltage detection, i.e. the switch SW1 is switched to point B. At this time the value of the voltage $V_{FB3}$ at the point C is detected. This detected value of voltage $V_{FB3}$ is then converted to a digital value by the A/D convertor 50 and is then transmitted to controller 25. Here, since the applied voltage V is the sum ($V_{FB3}$+the voltage drop of the applied voltage due to the resistor R21), the applied voltage can be calculated as follows:

applied voltage $V=V_{FB3}+R21\times(V_{FB3}/R22)$.

The present invention also calculates a total current. In this detection operation, the switch SW1 is changed over to a total current detection side, i.e. the switch is connected to point A. The total current outputted from the high voltage power source is $I_{total}=I_v+(I_r+I_t)$. The sum of $I_r$ and $I_t$ flows through the resistor 207, and $I_v$ flows through the resistor R21. As a result, in order to obtain a total current ($I_{total}$), the voltage $V_{FB1}$ at the point D and the voltage $V_{FB3}$ at the point C are respectively detected. The values of these detected voltages are then respectively converted to digital values by A/D converter 50 and transmitted to the controller 25. However, since the value of the voltage at point D is negative for ground, the value of $V_{FB1}$ is converted to a positive value in the polarity invertor circuit 55 before being transmitted to the A/D convertor 50.

In this way, the total current $I_{total}$ can be calculated as follows:

$I_{total}=V_{FB3}/R22+(-V_{FB1}/\text{Resistance value of resistor } 207)$.

The present invention also provides an operation of calculating a feedback current $I_r$ which flows through the driven roller 203 and the driving roller 202 from the high voltage power source, and which further flows through the resistor R24. In such a state, the voltage $V_{FB2}$ at the point E is detected. The value of this detected voltage is converted to a digital value by the A/D convertor 50, and is then transmitted to the controller 25. In the controller 25, the feedback current $I_r$ is calculated as follows:

$$I_r=V_{FB2}/R24.$$

The present invention also calculates a transfer current ($I_t$), which is a value obtained by subtracting $I_r$ from the current ($I_r+I_t$) flowing through the resistor 207.

For obtaining $I_t$ the voltage $V_{FB1}$ at point D and the voltage $V_{FB2}$ at point E are detected.

These detected values are then converted to digital values by the A/D convertor 50 and are transmitted to the controller 25. However, since the value of the voltage at the point D is negative respective to ground, $V_{FB1}$ is converted to a positive value by passing through polarity inverting circuit 55 before being input to the A/D convertor 50.

In the controller 25 then, the transfer current $I_t$ can be calculated as follows:

$I_t+(-V_{FB1}/\text{resistance value of resistor } 207)-(V_{FB2}/R24)$.

The present invention can also control this transfer current $I_t$ to be constant.

In the image forming apparatus of the present invention, a pulse with modulation control is performed such that the transfer current $I_t$ is always constant. The pulse with modulation control signifies that the output signal is changed in accordance with the duty (rate) of ON/OFF of the PWM signal.

As shown in FIG. 4, the high voltage power source 206 includes a voltage increasing transformer 208 and several circuit elements of the secondary side thereof, and a switching transistor 209. In the PWM control for the transfer current $I_t$ obtained by the above-mentioned construction, the value of the transfer current $I_t$ as calculated by the above method and a target value (a transfer current previously set) are compared with each other, and the duty of the driving signal to be applied to the switching transistor 209 is controlled such that these values are equal by controlling PWM timer 60.

This operation is also shown in the flowchart of FIG. 5(*b*) which shows in step S1 that the analog to digital converted data is compared with a target value. If the digital data is less than the target value, a new PWM data is set by adding to the previous PWM data the target value minus the digital data value times a gain. If the digital data value exceeds the target value, the new PWM data is set by adding to the previous PWM data the digital data value minus the target value times again.

In this way, the high-voltage power source 206 may include a control performing a PWM (Pulse Width Modulation) control so as to make a value of the current flowing through the current detecting resistor 207 always constant. For this reason, it is possible to make a value of the current flowing through the photosensitive drum 11 always constant regardless of the resistance value of the transfer conveying belt 201 and the thickness of the transfer paper, and thereby a preferable image can always be obtained.

Next, the transfer conveying belt 201 is explained.

Figure 6:
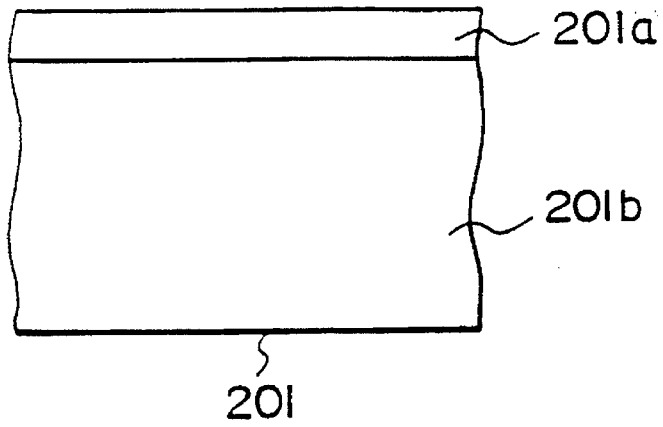
FIG. 6 is a cross sectional view showing a construction of a transfer conveying belt in the first embodiment.

As shown is FIG. 6, the transfer conveying belt 201 is constructed with two layers 201*a* and 201*b*. The surface coating layer 201*a* of the first layer is formed on the second layer 201*b* by coating a coating solution (a solution made by dispersing PTFE into a urethane resin) of inherent volume resistance $1\cdot10^{11}$~$1$–$10^{14}$ [Ω·cm]. The resistance value of the first layer is adjusted by changing the thickness thereof so as to make the surface resistance rate at normal temperature and humidity, e.g., 23° C. 65% RH equal to a value within $1\cdot10^{10}$~$1\cdot10^{16}$ [Ω]. To state more concretely, the thickness of the surface coating layer 201*a* may be set to approximately 3 μm–5 μm.

Next, the second layer 201*b*, which is a base layer, is made of a semiconductive rubber of a rubber material having a comparatively large temperature/humidity dependability of the electric resistance value and which may be, e.g., based on chloroprene rubber. The resistance value of the second layer 201*b* is adjusted so as to make the surface resistance value rate at the normal temperature and humidity equal to $1\cdot10^{7}$~$1\cdot10^{11}$ [Ω], and more preferably $2\cdot10^{9}$~$4\cdot10^{9}$ [Ω].

Here, in the resistance value adjustment of the second layer 201*b* for making the rubber material semiconductive, the mixing of an ion conductive material is a main procedure, and the mixing of an adequate amount of conductive material such as carbon is done in order to obtain a surface resistance value variation corresponding to a resistance value variation in a range of more than the order of 0.5 and less than the order of 3 for the temperature/humidity variation (low temperature/low humidity: 10° C., 15% RH; high temperature/high humidity: 30° C., 90% RH).

Preferably, the variation of the surface resistance value rate of the second layer 201*b* due to the temperature/humidity variation should be set to on the order of 2.

In the present invention, the transfer conveying belt 201 itself is employed as a temperature/humidity sensor. In a case that carbon as the ion conductive material is mixed with the rubber material, if the amount of carbon to be dispersed is excessively large, there occurs as properties inherent to the mixture of carbon a time elapsing variation of the resistance value, an unevenness at the time of manufacturing, and a low dependability of the resistance value on the voltage, etc., and thereby the stability of the temperature/humidity sensor disappears. For this reason, it is preferable to make the amount of the carbon to be mixed with the rubber material a minimum. For instance, the thickness of the second layer 201*b* is set to approximately 0.5 μm.

In such a manner, since the transfer conveying belt 201 employs a material having a resistance value which varies due to temperature/humidity variations, not only can the belt 201 be used as a temperature/humidity sensor, but the image quality thereof can be largely improved.

The above matters are described in more detail, hereinafter.

The present embodiment may relate to a two-colors image forming apparatus. In the embodiment, the second developing apparatus 18 for developing the second color image may adopt a non-contact type one-component developing method, e.g., of a red or blue toner. In such a developing method, since the amount of the electric charge of the charged toner contained in the second developing apparatus 18 cannot be raised compared with a case of a contact type two-components developing method, the amount of the electric charge of the charged toner after developing and the same after transferring (hereinafter, called "Q/M") become very small. And thereby, the electrostatic absorbing force between the toner and the transfer paper becomes very faint, i.e., there is not a strong force attracting the toner to the transfer paper, and therefore the toner image is apt to be disturbed easily by only a small change of the electric field. Such a phenomenon occurs prominently in the environment of low temperature and low humidity.

However, if the amount of the peeling-off discharging of the electric charge is increased at the outlet of the transfer nip portion, since the Q/M (the amount of the electric charge of the charged toner) of the toner on the transfer paper after transferring can be increased, the above matter can be largely improved. To state briefly, although the level of the image noise becomes better if the transfer current is increased, the level of the image noise varies also by variation in resistance of the transfer conveying belt 201.

Figure 7:
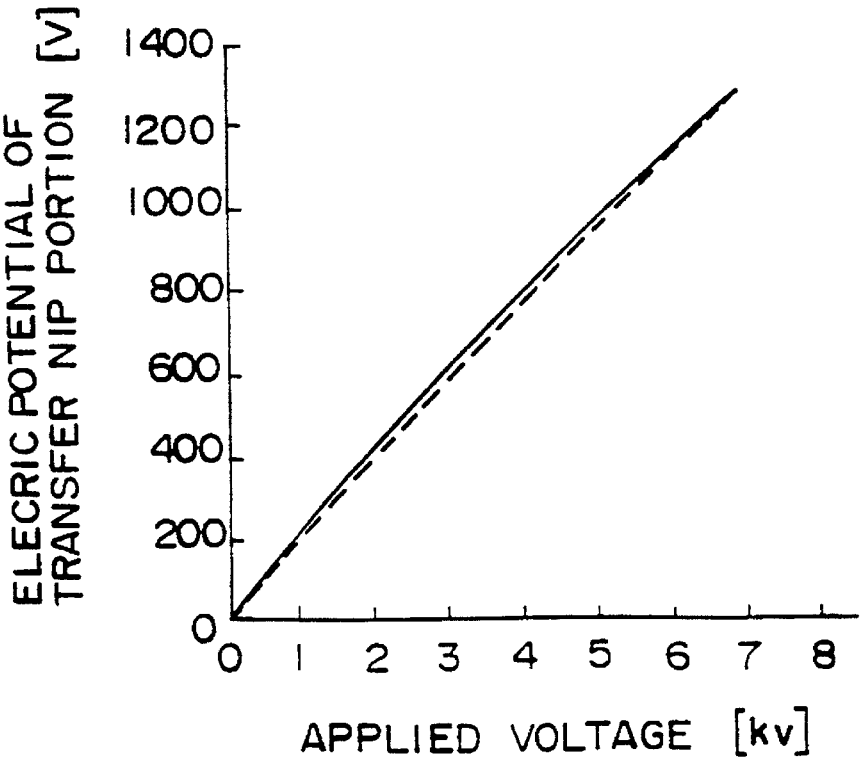
FIG. 7 is a graph showing a relationship between a voltage to be applied to a transfer conveying belt from a high voltage power source for use in transferring and an electric potential of the transfer conveying belt at a transfer nipping portion.

Namely, although the peeling-off discharging amount at the outlet of the transfer nip portion formed by the photosensitive drum 11 and the transfer conveying belt 201 is determined by the strength of the electric field at the transfer nip portion, the electric potential on the transfer conveying belt 201 at the transfer nip portion is determined according to one meaning by the applied voltage of the transfer conveying belt 201, as shown in FIG. 7. However, in the transfer conveying belt 201 of a low resistance value, even if the transfer current is increased, the electric potential on the transfer conveying belt at the transfer nip portion does not increase. Consequently, in a transfer conveying belt of a low resistance value, the peeling-off discharging amount is small, and thereby the level of the image noise is high, i.e., there is too much noise.

Figure 8:
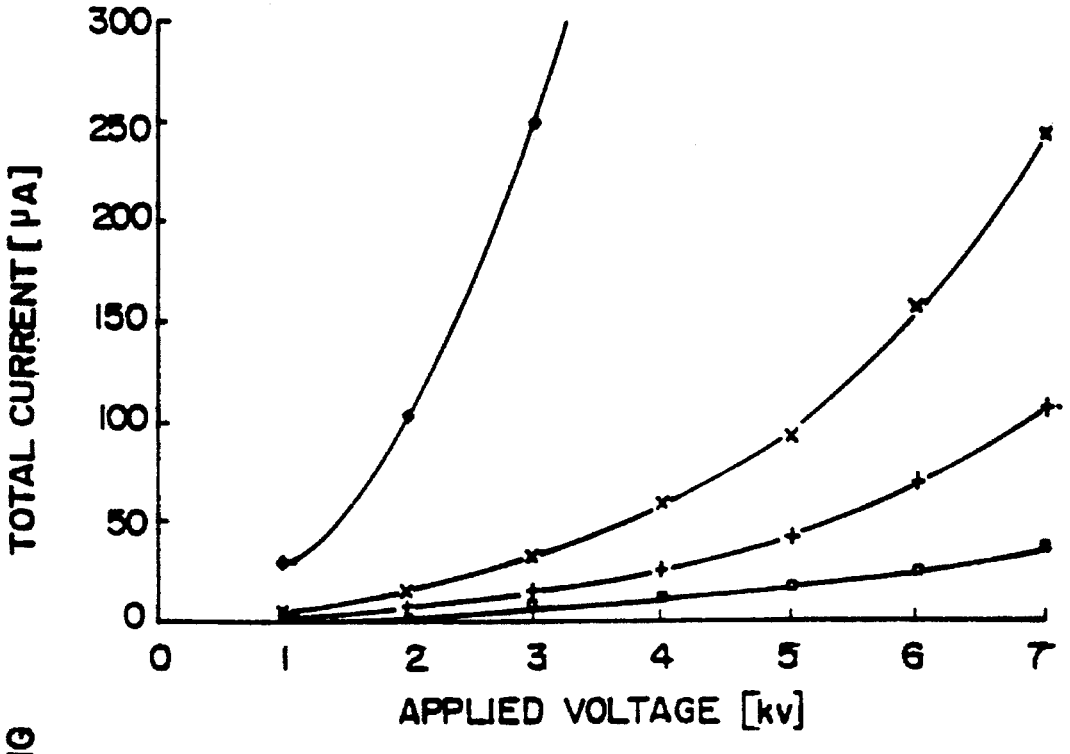
FIG. 8 is a graph showing a relationship between a voltage to be applied to a transfer conveying belt from a high voltage power source for use in transferring and a total current.

Furthermore, in the case of imparting semiconductivity to the transfer conveying belt 201 by the dispersion of carbon therein to increase the resistance value of the transfer conveying belt, even though the transfer current is increased (even though the applied voltage on the transfer conveying belt is increased), the resistance of the transfer conveying belt 201 has a property of voltage dependability, and thereby a sufficient effect cannot be obtained. Here, a relationship between the applied voltage of the transfer conveying belt 201 and the total current from the high-voltage power source 206 to the transfer conveying belt 201 becomes a secondary (quadratic) curve as shown in FIG. 8. When the applied voltage of the transfer conveying belt 201 is increased, the resistance value thereof is lowered. In FIG. 8, the resistance value is determined in accordance with an inclination of the tangent lines of the respective curves. When the applied voltage is increased, the inclination of the tangent line begins to become large at a point; namely, the resistance value is lowered.

Figure 9:
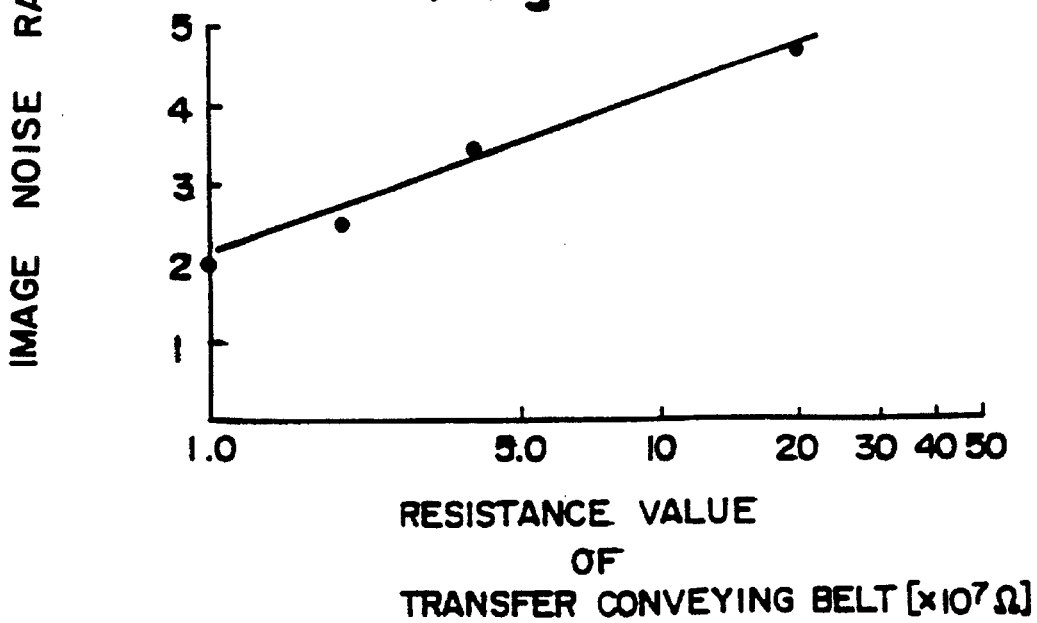
FIG. 9 is a graph showing a resistance value of a transfer conveying belt and a ranking of image noise.

And further, the resistance variation of the transfer conveying belt 201 of carbon dispersion due to the temperature/ humidity variation is small. Since the unevenness at the time of manufacturing is large then, as shown in FIG. 9, although a preferable image without any image noise can be obtained at an upper limit of the resistance value unevenness, a level of the image noise is not acceptable at a lower limit of the resistance value unevenness. Consequently, the image qualities are different from each other according to the transfer conveying belt.

Figure 15:
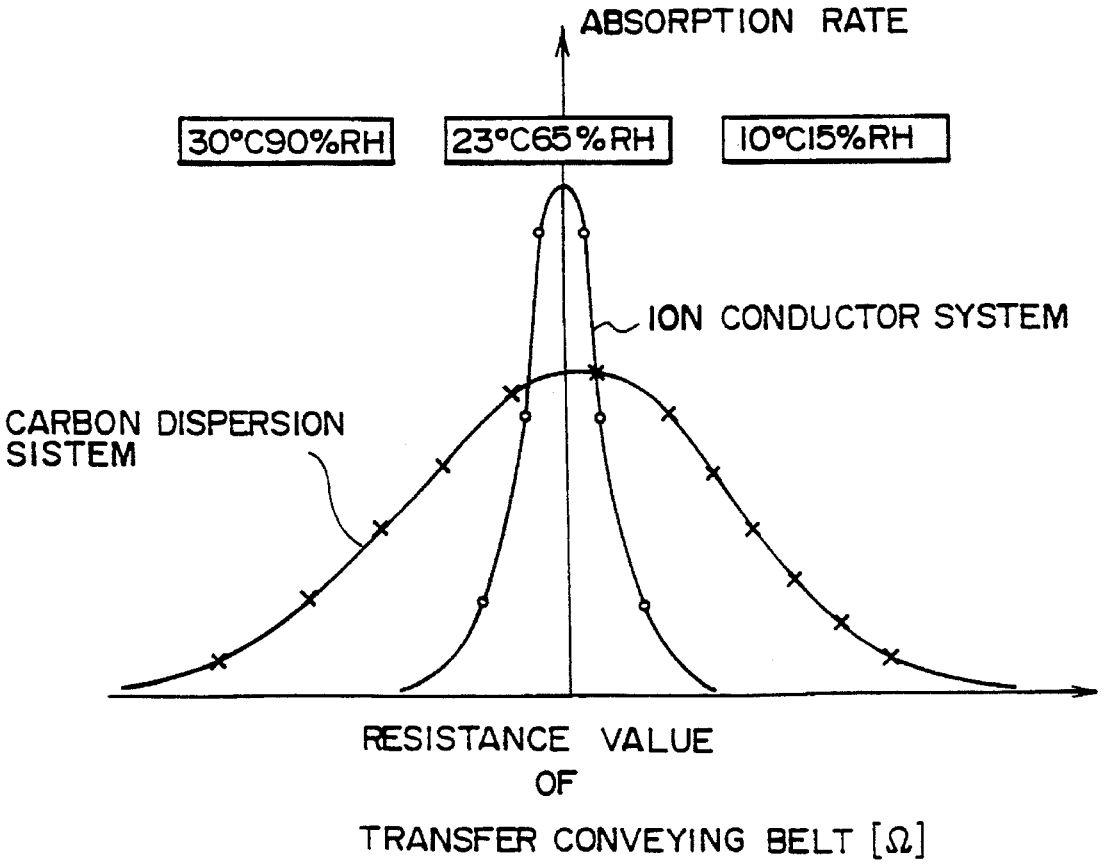
FIG. 15 is a graph showing unevenness of manufacturing of a transfer conveying belt.

Here, as shown in FIG. 15, regarding a transfer conveying belt of the carbon dispersion system, the manufacturing unevenness is large while the environmental variation is small. For this reason, regarding the transfer conveying belt of the carbon dispersion system, the level of the image noise is too high at the lower limit of the resistance value due to the manufacturing unevenness. On the contrary, regarding a transfer conveying belt of the ion conduction system, the manufacturing unevenness is small while the environmental variation is large. However, regarding the transfer conveying belt of the ion conduction system, in the environment of low temperature and low humidity where the image noise is apt to occur, since the resistance value varies in a preferable direction (high resistance value side), the lot unevenness of the image noise level is small.

The two layered belt 201 of the present invention as shown in FIG. 6 overcomes such drawbacks. That is, on the other hand, regarding the transfer conveying belt 201 according to the embodiment of the present invention, the resistance value becomes high owing to the temperature/humidity dependability of the resistance value in the environment of low temperature and low humidity where the image noise is apt to occur, and thus a preferable image can be obtained without causing any image noise.

Furthermore, in the belt 201 of the present invention the resistance value unevenness at the time of manufacturing becomes very small (approximately zero), and thus there occurs no difference in the level of the image quality due to the transfer conveying belt 201.

And further, in the belt 201 of the present invention there hardly exists any temperature dependability of the resistance value. When the transfer current is increased, the applied voltage of the transfer conveying belt 201 increases linearly. Namely, the electric potential on the transfer conveying belt 201 at the transfer nip portion thereof increases linearly, and the peeling-off discharging amount also increases linearly. Consequently, the effect at the time of increasing the transfer current becomes considerably large compared with the transfer conveying belt of the carbon dispersion system.

Figure 10:
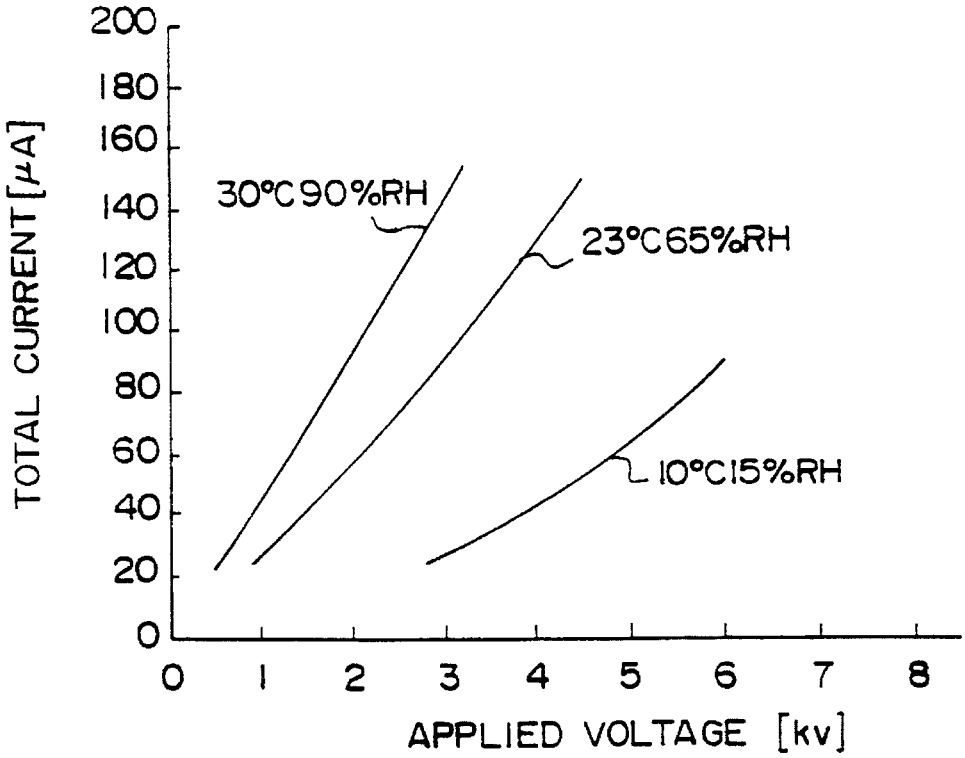
FIG. 10 is a graph showing a relationship between a voltage to be applied to a transfer conveying belt from a high voltage power source, total current, and temperature and humidity in the first embodiment.

In the embodiment of the present invention, FIG. 10 shows relationships between total current and applied voltage both supplied from the high-voltage power source 206 for transferring the image to the transfer conveying belt 201 at the time of outputting the image in the respective environments; low temperature/low humidity: 10° C., 15% RH; normal temperature/normal humidity: 23° C., 65% RH; high temperature/high humidity: 30° C., 90% RH.

As is apparent from FIG. 10, when the resistance value of the transfer conveying belt 201 varies due to temperature/humidity variations, the output characteristic between the total current and the applied voltage also varies. Therefore, if the values of the total current and the applied voltage from the high-voltage power source 206 to the transfer conveying belt 201 are measured as discussed above with respect to FIG. 4, the approximate values of temperature and humidity can be calculated.

That is, after the defined applied voltage and total current are detected as discussed above with respect to FIG. 4, and as the relationships as shown in FIG. 10 exist, the values of applied voltage and total current can be utilized to determine approximate temperatures and humidities in view of the relationship shown in FIG. 10.

Although FIG. 10 shows the output relationships between the total current and the applied voltage supplied from the high-voltage power source 206 for transferring to the transfer conveying belt 201 at the time of forming the image, the calculation of the temperature/humidity is not always limited to the time of forming the image. It is also possible to calculate the temperature/humidity at a time when the recording paper is not conveyed. On this occasion, since the transfer conveying belt 201 is brought into direct contact with the photosensitive drum 11 without interposing the transfer paper therebetween, the photosensitive drum 11 becomes charged in an inverse polarity, and thereby an abnormal image such as an image fading-away may occur. Therefore, it is preferable to move the transfer conveying belt 201 away from the photosensitive drum 11 and calculate the temperature/humidity in such a non-contact situation.

Figure 11:
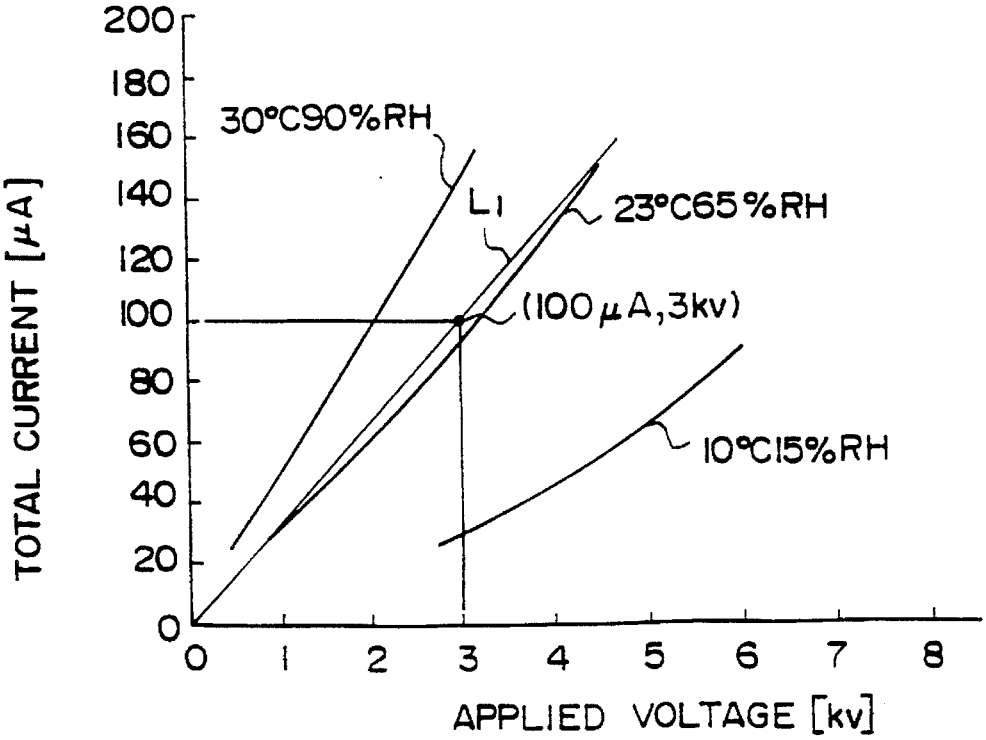
FIG. 11 is a graph for explaining the first embodiment of the present invention.

As mentioned heretofore, since the resistance value of the transfer conveying belt 201 varies due to the ambient temperature/humidity variation, in the embodiment of the present invention the output relationships between the total current and the applied voltage both supplied from the high-voltage power source 206 for transferring to the transfer conveying belt 201 may be divided into two areas by the threshold line L1 including a line traversing the origin, as shown in FIG. 11. The controller 25 then detects one of the areas thus divided to which the voltage and/or current outputted at the time of transferring from the high-voltage power source 206 for transferring may belong. In such a manner, the approximate temperature and/or humidity as the installing environment of the present invention can be detected to belong to either one of the low temperature/low humidity, i.e., to the right of line L1, or the high temperature/high humidity, i.e., to the left of line L1. The controller 25 can then perform various control operations on the basis of the above-mentioned result.

Figure 12:
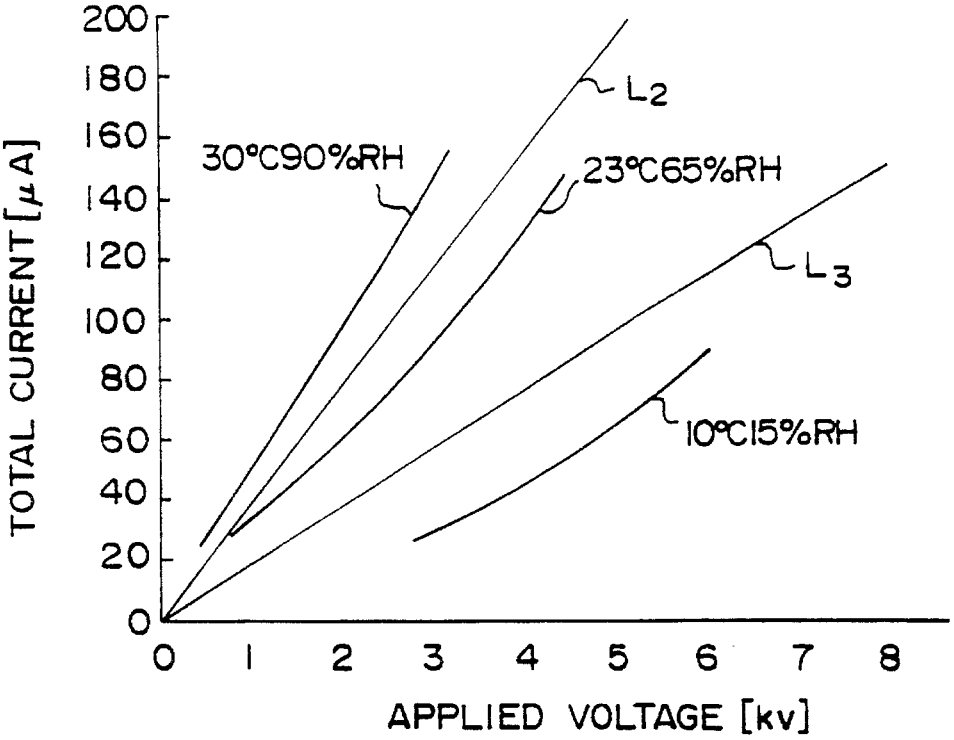
FIG. 12 is a graph for explaining a further embodiment of the present invention.

Furthermore, in another embodiment of the present invention, the output relationships between the total current and the applied voltage supplied from the high-voltage power source 206 may be divided into three areas by threshold lines L2 and L3 including lines respectively traversing the origin, as shown in FIG. 12, and the controller 25 then detects one of these three areas thus divided to which the voltage and/or current outputted at the time of transferring from the high-voltage power source 206 may belong. For example, these three areas of the voltage outputted from the power source 206 may be less than 2.1 V, 2.1 V to 2.5 V, and more than 2.5 V. In such a manner, the approximate temperature and/or humidity as the installing environment of the present invention can be detected to belong to either one of the low temperature/low humidity, i.e., to the right of line L3, normal temperature/normal humidity, i.e., between lines L2 and L3, and high temperature/high humidity, i.e., to the left of line L2. The controller 25 can then perform various control operations on the basis of the above-mentioned result.

In the first embodiment, a couple of humidity removing heaters 28 and 29 for performing humidity removal respectively may also be mounted on an upper part of the paper feeding apparatuses 19, 27 (at a lower side of the transfer conveying belt 201) and on a lower part of the same 19, 27 (at the bottom plate of the first embodiment). These humidity removing heaters 28 and 29 are provided for the purpose of coping with the troublesome matters such as non-conveying of the paper, inferior transferring, etc. occurring when the transfer paper absorbs too much humidity. However, the purpose of removing humidity becomes meaningless and not necessary to provide at low temperatures.

Nevertheless, when the humidity removing heaters 28 and 29 are kept turned on, the transfer paper may be unnecessarily excessively humidity-removed, and thereby the dielectric constant of the transfer paper is raised and the transfer paper is apt to be charged easily. In particular, in the case of a two-sided copy mode, when an image is formed on a rear surface of the transfer paper, the toner image formed on the transfer paper is put electrostatically in a very unstable state in a procedure of conveying the transfer paper from a transferring process to a fixing process (for instance, when the transfer paper is separated from the transfer conveying belt 201). As a result, when an electric field sharply changes, the toner image is disturbed and thereby an abnormal image may occur.

As mentioned heretofore, in the low-temperature environment, the humidity removing heaters 28 and 29 are not only unnecessary, but may cause the occurrence of an abnormal image to accelerate. For this reason, in the first embodiment, as shown in FIG. 11, the line L1 traversing the point of (total current, applied voltage)=(100 μA, 3 KV) and the origin is employed as a threshold line, and the controller 25 detects the divided value area to which the voltage applied from the high-voltage power source 206 for transferring to the transfer conveying belt 201 and thereby determines the low temperature/low humidity or high temperature/high humidity as the outlined installing environment of the first embodiment. On the basis of the detected result, the controller 25 turns off the humidity heaters 28 and 29 when the low temperature/low humidity environment is detected and turns on the humidity heaters 28, 29 when the high temperature/high humidity environment is detected.

Furthermore, the ON-OFF control of the humidity removing heaters 28 and 29 is performed for another purpose. Namely, in a case that a member having temperature/humidity dependability is employed as the transfer conveying belt 201, the following matter is very important. When the humidity removing heaters 28 and 29 are turned on in the low temperature/low humidity environment, a phenomenon that resistance values are different from each other at an upper-side portion and a lower-side portion of the transfer conveying belt 201 may happen due to unevenness of the temperature distribution in the first embodiment. In such a situation, not only is the efficiency of the temperature/humidity sensor of the transfer conveying belt 201 lowered, but the resistance value of the transfer conveying belt 201 varies at a boundary surface between the upper-side portion and the lower-side portion of the belt 201. This may then be a cause of an abnormal image occurrence. For this reason, the controller 25 turns off the humidity removing heaters 28 and 29 in the low temperature/low humidity environment.

As mentioned heretofore, in the first embodiment of the present invention a toner image is formed on the photosensitive drum 11 employed as an image carrier. The toner is formed by a first charger 13, a first writing-in unit 14, a first developing apparatus 15, a second charger 16, a second writing-in unit 17, and a second developing apparatus 18. In the image forming apparatus the transfer bias is applied to the transfer conveying belt 201 employed as a contact type transferring medium from the high-voltage power source 206 and the transfer material is conveyed by the transfer conveying belt 201, and further the toner image formed on the image carrier 11 is transferred to the transfer material on the transfer conveying belt 201.

The transfer conveying belt 201 includes at least two layers; namely which are, a first layer **201*a* having a surface resistance rate of $1\text{–}10^{10}\sim1\cdot10^{16}$ and a second layer 201*b*** having a surface resistance rate of $1\cdot10^{7}\sim1\cdot10^{11}$ and which is constructed with a rubber material of comparatively large temperature dependability of electric resistance. In such a construction, the level of the image noise likely to occur in the low temperature/low humidity environment becomes uniformly improved regardless of the manufacturing lot of the transfer conveying belt because of small unevenness in the manufacturing of the belt. Furthermore, the troublesome matters on the image quality and the transfer material conveying quality can be solved without employing any temperature/humidity sensor, and thereby a preferable image can be obtained.

And further, in the first embodiment, since the variation range of the resistance (surface resistance rate) due to the temperature/humidity variation is in the range from the order of 0.5 to the order of 3.0, the transfer conveying belt 201 transfers the toner image formed on the image carrier 11 to the transfer material and conveys the transfer material in a state of electrostatically absorbing the toner image. Since the transfer conveying belt 201 has not only a function of conveying a transfer material, but also the function of a temperature/humidity sensor, it is possible to realize considerable cost-reduction and simplification of the apparatus compared with a case of providing a temperature/humidity sensor as another separate unit.

And further, in the first embodiment, the transfer conveying belt 201 is employed as the temperature/humidity sensor, and the controller 25 detects the total current and voltage outputted (applied) to the transfer conveying belt 201 from the high-voltage power source 206, and thereby can determine the approximate temperature and humidity. Consequently, the transfer conveying belt 201 can be utilized also as a temperature/humidity sensor. Therefore, lit is possible to realize considerable cost-reduction and simplification of the apparatus compared with a case of providing a temperature/humidity sensor as another separate unit. Furthermore, it is possible to utilize the transfer conveying belt 201 simply as a temperature sensor or as a humidity sensor.

And further, in the first embodiment, since humidity removing heaters 28 and 29 are provided for removing humidity and controller 25 is employed for performing an ON-OFF control operation in accordance with the humidity for the humidity removing heaters 28 and 29 on the basis of the detection value (total current and voltage) outputted to the transfer conveying belt 201 from the high-voltage power source 206, it is possible to obtain further stable functions of transferring and transfer material conveying, and further energy saving can be accomplished. Furthermore, it is possible to realize considerable cost-reduction and simplification of the apparatus compared with a case of providing a temperature/humidity sensor as another separate unit.

In a further feature of the present invention, instead of or in addition to performing the ON-OFF control of the humidity removing heaters 28 and 29 by use of the controller 25, a heater for preventing dew condensation may be provided, and this heater may be turned on in the low temperature/low humidity environment and turned off in the high temperature/high humidity environment. In such a construction, a same effect as that of the first embodiment can be obtained.

In a further feature of the present invention, instead of employing a control for performing the PWM (Pulse Width Modulation) control of the high-voltage power source 206 so as to make the value of the current flowing through the current detecting resistor 207 always constant, the control operation may be performed so as to make the voltage to be applied to the transfer conveying belt 201 from the power source 206 constant. The transfer conveying belt 201 is employed as a sensor for detecting the temperature and the humidity. The controller 25 detects a total current outputted to the transfer conveying belt 201 from the power source 206 and determines either one of the value areas divided by the threshold line L1 to which the total current outputted to the transfer conveying belt 201 from the high-voltage power source 206 belongs, and thereby either one of the approximately low humidity and the approximately high humidity is detected as an installing environment.

On the basis of the result of the above detection, the humidity removing heaters 28 and 29 are turned off in the low humidity environment and turned on in the high humidity environment. For this reason, the transfer conveying belt 201 can be utilized also as a humidity sensor. Therefore, it is possible to realize considerable cost-reduction and simplification of the apparatus compared with the case of providing a humidity sensor as another separate unit.

Figure 13:
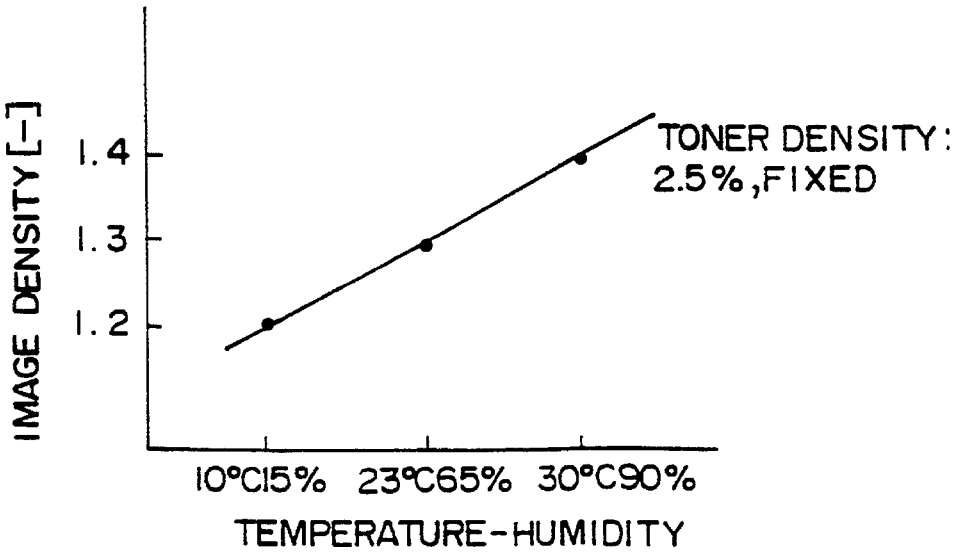
FIG. 13 is a graph showing a relationship between temperature/humidity and image density in the first embodiment in a case of omitting a density detector in the first embodiment.

In the above-mentioned embodiment, the controller 25 changes the toner density control standard value Vref on the basis of the output value of the density detector 26 and controls the toner supplementing portion 158 so as to make the image density constant. However, in a case of not employing the density detector 26 and not changing the toner density control standard value Vref by use of the control portion 25 on the basis of the output value of the density detector 26, the Q/M of the toner may be changed by the temperature/humidity variation, and thereby the image density varies in accordance with the temperature/humidity environment as shown in FIG. 13.

Figure 14:
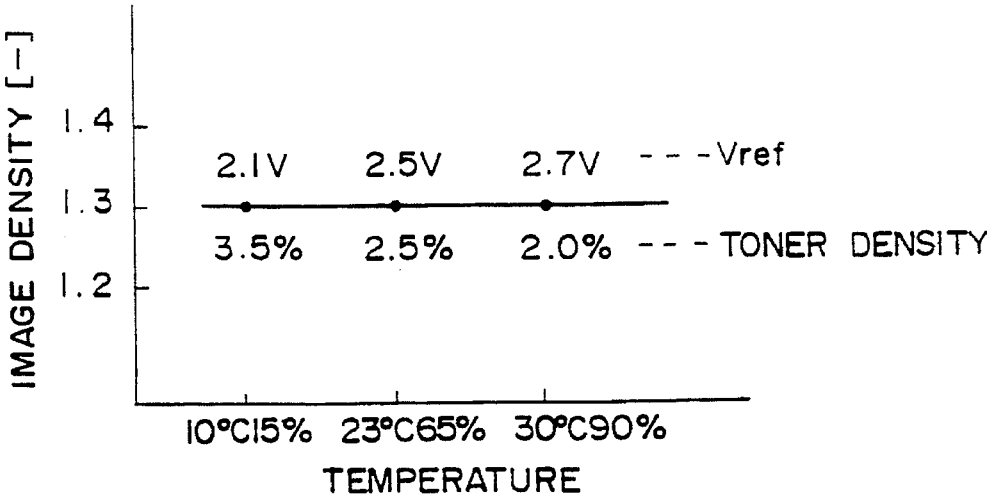
FIG. 14 is a graph showing a relationship between temperature/humidity and image density in a further embodiment of the present invention.

In a further embodiment of the present invention, the density detector 26 may not be employed. As shown in FIG. 12, the output relationships between the total current and the applied voltage both supplied to the transfer conveying belt 201 from the high-voltage power source 206 is divided into three areas by the threshold lines L2 and L3 traversing the origin. Thereby, the temperature/humidity environment is also divided into three areas. The toner density control standard value Vref may be previously set per respective temperature/humidity environments. And further, the controller 25 detects either one of the divided areas to which the total current and applied voltage both supplied to the transfer conveying belt 201 from the high-voltage power source 206 for transferring belong, by the threshold lines L2 and L3. Thereby, the controller 25 can determine either one of the outlined temperature/humidity environments divided into three. On the basis of the detection result, the toner density control standard value Vref is changed to a previously set toner density control standard value. As a result, in this further embodiment, an image of always constant density can be obtained over the entire temperature/humidity environment as shown in FIG. 14.

In this further embodiment of the present invention, with the charger 13, the first writing-in unit 14, and the first developing apparatus 15 form a latent image on the image carrier 11, and the formed latent image is converted to a toner image by developing the image with two-components developer by use of the first developing apparatus 15. The toner density of the two-components developer in the developing medium 15 is controlled with the toner density control standard value Vref. And further, the controller 25 is employed for changing the toner density control standard value Vref by the total current and voltage outputted to the transfer conveying belt 201 from the high-voltage power source 206 in accordance with the detected temperature/humidity environment. Consequently, a further stable and preferable image can be obtained, compared with an apparatus simply omitting a temperature/humidity sensor. And further, it is possible to realize cost-reduction and simplification of the apparatus, compared with a case of providing a temperature/humidity sensor as a separate unit.

In a further embodiment of the present invention relating to the first embodiment, instead of the contact type transferring medium 20, a contact type transferring medium such as a transferring roller having a comparatively large temperature/humidity dependability of the electric resistance without using a transfer conveying belt 201 can be utilized. In such a construction, the same effects as that of the first embodiment can be obtained.

In a further embodiment of the present invention, the basic layer 201*b* of the contact type transferring medium such as the transfer conveying belt 201 and the transferring roller, etc. may be constructed of a material of comparatively large temperature/humidity dependability excluding semiconductive rubber, and thereby, the same effects as that of the first embodiment can be obtained.

In a further embodiment of the present invention relating to the first embodiment, a construction element employed in another process than the transferring process is constructed with a material having the comparatively large temperature/humidity dependability of the electric resistance as in the case of the transfer conveying belt 201, and this other construction element may then be employed as the temperature/humidity sensor in order to perform various controls, and it is possible to obtain the same effects as that of the first embodiment.

Furthermore, the present invention is not limited to the above-mentioned embodiments. For instance, it is allowable that the transfer conveying belt 201 is employed, not only as the temperature/humidity sensor but as only a temperature sensor or a humidity sensor, and the transfer conveying belt 201 detects the total current or voltage outputted to the transfer conveying belt 201 from the high-voltage power source 206 for transferring and thereby the approximate temperature or humidity can be determined. Furthermore, the transfer conveying belt 201 can be constructed with the layers equal to or more than three.

Obviously, numerous additional modifications and variations of the present invention are possible in light of the above teachings. It is therefore to be understood that within the scope of the appended claims, the present invention may be practiced otherwise than as specifically disclosed herein.

What is claimed as new and desired to be secured by Letters Patent of the United States is:

1. An image forming apparatus in which a toner image is formed on an image carrier, a voltage is applied to a transfer conveying unit employed as a contact type transferring unit from a high-voltage power source, a transfer material is conveyed by said transfer conveying unit, and said toner image formed on said image carrier is transferred onto said transfer material, wherein said transfer conveying unit comprises:

a first layer having a surface resistance rate of $1\cdot10^{10}$~$1\cdot10^{16}$; and a second layer having a surface resistance rate of $1\cdot10^{7}$~$1\cdot10^{11}$; and wherein said second layer is constructed with a rubber material having a temperature/humidity variation of electric resistance which is larger than a temperature/humidity variation of electric resistance of said first layer.

2. The image forming apparatus as defined in claim 1, wherein said transfer conveying unit includes a transfer conveying belt incorporating the first and second layers.

3. An image forming apparatus as defined in claim 2, further comprising:

means for detecting an applied voltage and a total current from said transfer conveying belt; and a controller for determining at least one of approximate temperature and humidity based on at least one of the detected applied voltage and total current.

4. An image forming apparatus as defined in claim 3, wherein said controller further controls a toner density of a two-components developer in a developing unit by comparing a detected toner density with a predetermined control standard; and wherein said controller changes said predetermined control standard based on the determined at least one of approximate temperature and humidity.

5. An image forming apparatus as defined in claim 3, further comprising:

a heater; and wherein the controller performs ON-OFF control of said heater based on the determined at least one of approximate temperature and humidity.

6. An image forming apparatus as defined in claim 1, wherein an electric resistance variation range of said second layer due to the temperature/humidity variation is in a range of an order of 0.5 to an order of 3.0.

7. An image forming apparatus as defined in claim 1, wherein a controller controls the voltage applied to said transfer conveying unit from said high-voltage power source to be constant.

8. An image forming apparatus as defined in claim 7, further comprising:

means for detecting an applied voltage and a total current from said transfer conveying unit; and a controller for determining at least one of approximate temperature and humidity based on at least one of the detected applied voltage and total current.

9. An image forming apparatus including a rotatable image carrier, a charging unit for uniformly charging said image carrier, an exposing unit for forming an electrostatic latent image on said image carrier, and a developing unit for developing said latent image carrier, said image forming apparatus comprising:

a transfer material for transferring thereto a toner image formed on said image carrier;

a transfer conveying unit for conveying said transfer material; and a high-voltage power source for applying a voltage to said transfer conveying unit;

wherein said transfer conveying unit comprises:

a first layer having a surface resistance rate of $1\times10^{10}$~$1\times10^{16}$; and a second layer having a surface resistance rate of $1\times10^{7}$~$1\times10^{11}$; and wherein said second layer is constructed with a rubber material having a temperature/humidity variation electrical resistance which is larger than a temperature/humidity variation of electrical resistance of said first layer.

10. An image forming apparatus as defined in claim 9, wherein said transfer conveying unit is a contact type unit including a transfer conveying belt.

11. An image forming apparatus as defined in claim 10, wherein a transfer bias is applied to said transfer conveying belt from said high-voltage power source through a bias roller, and thereby said transfer conveying belt electrostatically attracts said transfer material and conveys said transfer material, and after transferring said toner image onto said transfer material, said transfer conveying unit electrostatically separates said transfer material from said image carrier.

12. An image forming apparatus as defined in claim 11, further comprising a separation claw for further separating the transfer material conveyed by said transfer conveying unit.

13. An image forming apparatus as defined in claim 9, wherein said transfer conveying unit comprises:

a transfer conveying belt;

a driving roller for driving said transfer conveying belt;

a dependently moving roller, wherein said transfer conveying belt is bridged on both of said driving roller and said dependently moving roller;

a bias roller brought into direct contact with a surface of said transfer conveying belt; and a cleaning apparatus for cleaning said transfer conveying belt.

14. An image forming apparatus as defined in claim 13, wherein a transfer material is sent out from a registration roller to said transfer conveying belt, and a transfer bias of polarity opposite to a charging polarity of a black toner and a color toner is applied to said bias roller from said high-voltage power source.

15. An image forming apparatus as defined in claim 14, wherein an electric charge of a polarity opposite to the charging polarity of toner is applied to the transfer material at a transfer nip portion between said transfer conveying belt and said image carrier from said high-voltage power source through said bias roller and said transfer conveying belt, and thereby said toner image formed on said image carrier is transferred onto said transfer material.

16. A method of forming an image, comprising the steps of:

uniformly charging an image carrier by a charging unit;

forming an electrostatic latent image on said image carrier by an exposing unit;

developing said electrostatic latent image by a developing unit, to thereby form a toner image on said image carrier;

transferring said toner image formed on said image carrier onto a transfer material;

applying a voltage to a transfer conveying unit by a high-voltage power source; and conveying said transfer material thus image-transferred with said transfer conveying unit;

wherein said transfer conveying unit comprises a first layer having a surface resistance rate of $1\times10^{10}$~$1\times10^{16}$, and a second layer having a surface resistance rate of $1\times10^{7}$~$1\times10^{11}$, and wherein said second layer is constructed with a rubber material having a temperature/humidity variation of electrical resistance which is larger than a temperature/humidity variation of electrical resistance of said first layer.

17. A method of forming an image as defined in claim 16, wherein said transfer conveying unit is a contact type unit including a transfer conveying belt.

18. A method of forming an image as defined by claim 16, further comprising the steps of:

detecting an applied voltage and a total current from said transfer conveying unit; and determining at least one of approximate temperature and humidity based on at least one of the detected applied voltage and total current.

19. A method of forming an image as defined in claim 18, further comprising a step of controlling the voltage applied to the transfer conveying unit to be constant.

20. A method of forming an image as defined in claim 18, further comprising a step of controlling ON/OFF control of a heater based on the determined at least one of approximate temperature and humidity.

* * * * *